US005327047A

United States Patent [19]

Gershen

[11] Patent Number: 5,327,047

[45] Date of Patent: Jul. 5, 1994

[54] ELECTRICAL DIMMER SYSTEM EMPLOYING ALTERNATELY APPLIED SILICON CONTROLLED RECTIFIERS

[75] Inventor: Bernard Gershen, Centerport, N.Y.

[73] Assignee: Leviton Manufacturing Co., Inc., Little Neck, N.Y.

[21] Appl. No.: 954,229

[22] Filed: Sep. 30, 1992

[51] Int. Cl.[5] ..... G05F 1/00

[52] U.S. Cl. ..... 315/194; 315/307; 315/324; 323/223; 323/324; 323/327; 323/905

[58] Field of Search ..... 315/194, 307, 324; 323/223, 905, 324, 327; G05F 5/02

[56] References Cited

U.S. PATENT DOCUMENTS 3,401,265 7/1964 Dotto ..... 323/905
3,517,259 6/1970 Dotto ..... 323/905

OTHER PUBLICATIONS

H. M. Newsom, circuits to adjust current to match requirements of load, Nov. 1966.

*Primary Examiner*—James B. Mullins
*Assistant Examiner*—J. Dudek
*Attorney, Agent, or Firm*—Paul J. Sutton

[57] ABSTRACT

A dimmer control system includes two discrete silicon controlled rectifiers which respectively energize a lamp load during alternate half cycles of the input AC voltage. The separate placement of the SCRs ensures that much lower temperatures are reached than would occur if a single triac were used to energize a lamp during both half cycles. The system also includes a pair of diacs which energize the respective SCRs when a respective capacitor directly connected to each diac discharges through one of them. The system further includes a respective capacitor charging circuit for each capacitor, each of the two charge circuits including a series connections of the gate to cathode junction of the SCR other than the one which the capacitor being charged discharges through, a diode, a common fixed resistor, and a common variable resistor.

8 Claims, 1 Drawing Sheet

ELECTRICAL DIMMER SYSTEM EMPLOYING ALTERNATELY APPLIED SILICON CONTROLLED RECTIFIERS

BACKGROUND OF THE INVENTION

The present invention relates to a light dimmer circuit which uses two silicon control rectifiers (SCRs) to alternately energize a load, which can comprise one or more lamps, at adjustable points in the respective half cycles of an input AC voltage sine wave.

It is known in the prior art that a triac can be used to energize a load such as a lamp during alternate half cycles of an input AC voltage sine wave, and that the firing angle of the triac can be adjusted by various means to achieve a desired amount of dimming of the lamp. However, a problem which arises with the use of a triac is that, especially for high power light dimmers on the order of 2,000 watts or more, large heat sinks are required to dissipate the heat and to prevent possibly dangerous temperatures being reached in the dimmer circuit.

In addition to the aforementioned problem of a single triac in a dimmer circuit acting as a single point source of heat, leading to a hot spot, there is also a requirement for a low voltage drop for such triacs. This requirement necessarily increases the cost of these devices. Also known is a control circuit for progressively varying the illumination intensity of lamps comprising a single silicon controlled rectifier (thyristor) connected in series with a lamp load. This single SCR is gated by a unijunction transistor together with a charging circuit having a charging time higher than the charging time of the gate biasing circuit of the SCR such that the current flowing through the lamp load is progressively and gradually decreased at each cycle of the alternating current till it reaches zero, and afterward is increased to its full intensity in a similar cyclical manner.

Also known is a dimmer circuit wherein two SCRs respectively operate independently on opposite halves of the alternating current sine wave to convey current to a load such as a lamp. However, since these dimmer switches each provide a half-wave output having a direct current component, load devices suitable for only alternating current operation may not be employed. Also, unlike the present invention, the dimmer switches are connected in series with the AC voltage source in line with only one of the two source conductors supplying the load. Also, in the circuit of the present invention, each SCR also provides a voltage with a direct current component. The two direct currents however are in opposite directions end so, if the circuit components are symmetrical, there should not be any net D.C. Furthermore, the inventive circuit is also in series with only one of the two source conductors. The load is between the circuit and the other source conductor.

SUMMARY OF THE INVENTION

The present invention solves the above-mentioned problems created by using a single triac to energize a lamp load in a dimmer circuit by providing instead two SCRs, each one conducting for one half of the time. All other things being equal, the power dissipated by each SCR is one half that of a single triac. (The sum of the two would be the same as that of a single triac). Therefore, the heat delivered to the heat sink is applied at two points giving two "hot spots" each one with half the power of the single triac. This in turn makes the hot spot temperature lower than that of a single hot spot. Thus, the temperature generated at each SCR is considerably less than what would be generated at a single triac and consequently the size of the heat sinks for the respective SCRs can be made much smaller than the large heat sink which would be required for a single triac. Also, since SCRs generally have a lower forward voltage drop than triacs, the total power delivered by the two SCRs to the heat sink is less than the single triac. Triacs with forward voltage drops comparable to that of SCRs are not readily available but can only be selected by the manufacturer at additional cost. The two SCR circuits give the user the option of dissipating less power at two hot spots, or dissipating the same power at two hot spots by using lower cost SCRs. Thus an opportunity is created for buying two low cost SCRs such that their total cost is considerably less than the single high cost, low forward voltage triac which has hitherto been used in dimmer applications.

The dimmer circuit of the present invention comprises first and second input conductors in one of which conductors the load is connected in series, first and second SCRs each having their anode and cathode terminals connected between the first and second input conductors, first and second gate energization circuits for each SCR, comprising a capacitor connected in series with a diac, and a charging circuit for each said capacitor comprising a fixed resistor, common to both charging circuits, a variable resistor common to both charging circuits and in series with said fixed resistor, and a diode connected in parallel with a respective one of said diacs.

DETAILED DESCRIPTION OF THE INVENTION

Figure 1:
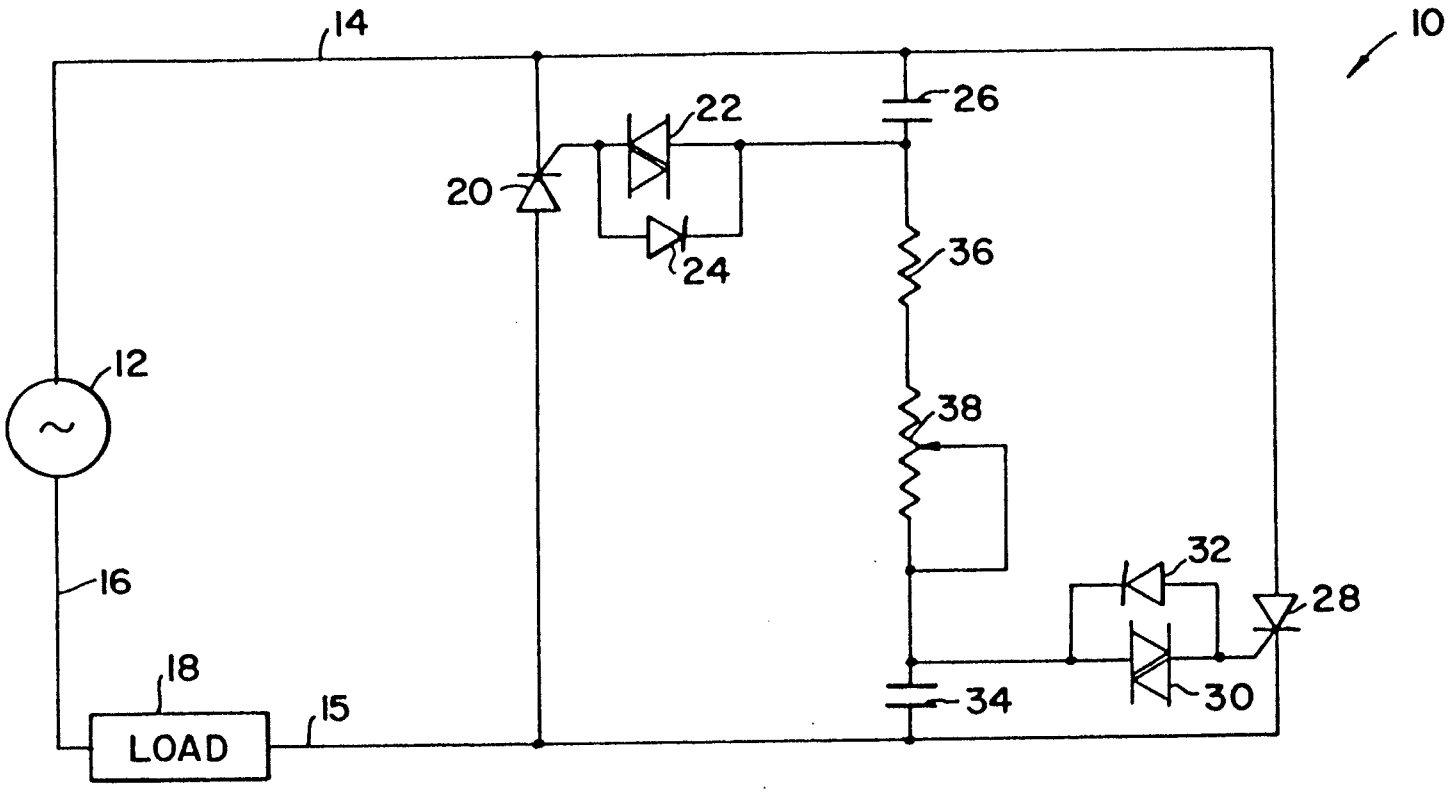
FIG. 1 is a schematic of the dimmer circuit of the present invention.

The drawing shows a dimmer circuit 10 having a variable voltage AC power supply 12 connected to its input conductors 14 and 16, the latter of which is connected to load 18, which can be one or more incandescent lamps, and which is connected at its other side to conductor 15.

The circuit further comprises a first silicon controlled rectifier (SCR) 20 connected between conductors 14 and 15 and having its gate terminal connected to a parallel combination of diac 22 and diode 24 which in turn are connected to conductor 14 through capacitor 26. A second SCR 28 is connected between conductors 14 and 15 in reverse fashion to SCR 20, i.e., its anode is connected to conductor 14 and its cathode is connected to conductor 15. The gate terminal of SCR 28 is connected through a parallel combination of diac 30 and diode 32 to conductor 15 through capacitor 34. Capacitors 26 and 34 are connected to each other through fixed resistor 36 and variable resistor 38.

The operation of the dimmer circuit is as follows:

When a positive half cycle of the input sine wave is applied to conductor 14, capacitor 34 charges through resistor 38, resistor 36, diode 24, and the forward gate-cathode junction of SCR 20. Eventually, the voltage on capacitor 34 exceeds the breakover voltage of diac 30 which then conveys charge from capacitor 34 to the gate of SCR 28, thus switching SCR 28 to an "on" conductor state.

When conductor 15 receives a positive half cycle of the input sine wave through conductor 16 and load 18, a similar triggering of SCR 20 occurs, i.e., capacitor 26 is charged through resistor 36, resistor 38, diode 32, and the gate-cathode junction of SCR 28 till the breakover voltage of diac 22 is reached and charge from 26 is conducted to the gate of SCR 20, thus switching it to an "on" conductive state.

The time in each half cycle in which the respective SCRs 20 and 28 are turned on is determined by the combined resistance of resistors 36 and 38, with 38 being a variable resistor whereby the amount of dimming desired can be adjusted.

Resistor 36 also performs the function of preventing the application of full line voltage to capacitors 26 and 34 in the event that the resistance of variable resistor 38 is adjusted to essentially a zero point. Such a situation, in the absence of resistance 36, would result in excessive current flowing into the gate terminals of the SCRs during the respective initial "turning-ons" of the SCRs 20 and 28.

It will be appreciated that variations and alterations to the disclosed preferred embodiment of the invention can be made without departing from the spirit and scope of the invention.

What is claimed is:

1. A dimmer control system comprising, in combination:

first and second conductors spaced apart from each other and respectively connected to the positive and negative terminals of an AC voltage source;

a first silicon controlled rectifier discrete current switching device and a second silicon controlled rectifier discrete current switching device, each of said switching devices connect between said fist and second conductors such that said first discrete current switching device conducts current to a load during a portion of the half cycles when positive AC voltage is applied to said first conductor and said second discrete current switching device conductors current to said load during a portion of the half cycles where positive AC voltage is applied to said second conductor;

first and second gate energization circuits respectively, connected to said first and second silicon controlled rectifiers; said first gate energization circuit comprises a first capacitor and a first diac connected in series with the gate terminal of said first silicon controlled rectifier and said second gate energization circuit comprises a second capacitor and a second diac connected in series with the gate terminal of said second silicon controlled rectifier.

2. The dimmer circuit of claim 1, further comprising first and second capacitor charging circuits, said first capacitor charging circuit comprising a first diode connected in series with the gate to cathode junction of said second silicon controlled rectifier and said second capacitor charging circuit comprising a second diode connected in series with the gate to cathode junction of said first silicon controlled rectifier.

3. The dimmer circuit of claim 2, further comprising a second series connection of a fixed resistor and a variable resistor, said second series connection of a fixed resistor and a variable resistor being connected in series with both said first diode and said second diode such that said fixed resistor prevents the full voltage from said AC voltage source from being applied to the respective gates of said first and second silicon controlled rectifiers regardless of the setting of said variable resistor.

4. The dimmer circuit of claim 2 wherein said first diode is connected in parallel with said second diac and said second diode is connected in parallel with said first diac.

5. The dimmer circuit of claim 3, wherein said first diode is connected in parallel with said second diac and said second diode is connect in parallel with said first diac.

6. The dimmer circuit of claim 1, wherein said load is connected in line with one of said first and second conductors.

7. The dimmer circuit of claim 1, wherein said load comprises one or more incandescent lamps.

8. The dimmer circuit of claim 6, wherein said load comprises one or more incandescent lamps.

* * * * *